US007478674B2

(12) United States Patent
Johnson

(10) Patent No.: US 7,478,674 B2
(45) Date of Patent: Jan. 20, 2009

(54) SYSTEM AND METHOD FOR FRACTURING AND GRAVEL PACKING A WELLBORE

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 168 days.

(21) Appl. No.: 10/513,829

(22) PCT Filed: Feb. 25, 2003

(86) PCT No.: PCT/US03/05904

§ 371 (c)(1),
(2), (4) Date: Dec. 22, 2005

(87) PCT Pub. No.: WO03/072902

PCT Pub. Date: Sep. 4, 2003

(65) Prior Publication Data

US 2006/0108115 A1 May 25, 2006

(51) Int. Cl.
*E21B 43/08* (2006.01)
*E21B 43/04* (2006.01)
*E21B 43/26* (2006.01)

(52) U.S. Cl. ..... 166/278; 166/308.1; 166/250.01

(58) Field of Classification Search ..... 166/278, 166/250.01, 308.1, 74
See application file for complete search history.

(56) References Cited

U.S. PATENT DOCUMENTS 4,105,069 A * 8/1978 Baker ..... 166/51
4,742,496 A * 5/1988 Jennings et al. ..... 367/35
5,050,674 A * 9/1991 Soliman et al. ..... 166/250.1
5,597,040 A * 1/1997 Stout et al. ..... 166/51
5,623,993 A * 4/1997 Van Buskirk et al. ..... 166/292
6,111,857 A 8/2000 Soliman et al.
6,364,015 B1 * 4/2002 Upchurch ..... 166/250.1
6,446,729 B1 * 9/2002 Bixenman et al. ..... 166/386
RE37,867 E * 10/2002 Gondouin ..... 166/380
6,464,006 B2 * 10/2002 Womble ..... 166/276
6,619,397 B2 * 9/2003 Coon et al. ..... 166/278

(Continued)

FOREIGN PATENT DOCUMENTS

EP 0 986 276 A2 3/2000

(Continued)

OTHER PUBLICATIONS

Wacker et al., "Matlab Implementation Of A Static Radio Network Planning Tool For Wideband CDMA"; Radio Network Planning and Optimisation for Limits, Laiho et al., ed; Wiley & Sons, pp. xxi, 98, 119, (2002).

(Continued)

*Primary Examiner*—Shane Bomar
(74) *Attorney, Agent, or Firm*—Steve Rosenblatt

(57) ABSTRACT

A method is disclosed for fracturing and gravel packing a subterranean well. The method allows gravel slurry to be pumped at high rates to fracture the earthen formation adjacent the wellbore. Also, the method allows the annulus between the gravel pack screen or liner and the casing to be tested for annular gravel filling. The method abates the abrasive wear on the casing wall and eliminates the crossover service to normally utilize during gravel pack and Frac Pack operations.

12 Claims, 7 Drawing Sheets

U.S. PATENT DOCUMENTS

2003/0148782 A1 8/2003 Gustafsson

FOREIGN PATENT DOCUMENTS

EP 1 292 162 A1 3/2003

WO 02/35872 A2 5/2002

OTHER PUBLICATIONS

"3rd Generation Partnership Project; Technical Specification Group Radio Access Networks; Radio Frequency (RF) System Scenarios (Release 6)"; 3GPP TR 25.942 V6.0.0, pp. 1-121, (2002).

* cited by examiner

SYSTEM AND METHOD FOR FRACTURING AND GRAVEL PACKING A WELLBORE

BACKGROUND OF THE INVENTION

1. Field of the Invention

This invention relates to a method of completing a well utilizing frac packing and gravel packing.

More particularly, this invention relates to a method for placing a gravel pack screen in a wellbore, pumping sand slurry at a high enough rate and pressure to fracture an earthen formation surrounding the wellbore, and after achieving a desired fracture length and width, utilize pressure and rate in a circulating position to test for a sufficient gravel filling of a screen/casing annulus. The method is performed without the use of a crossover service tool, thus abating the problems associated with abrasive wear on such tools caused by impingement of sand particles contained in a gravel slurry. Eliminating the problems associated with erosion, having the ability to test gravel pack screen assembly sand coverage, and pump additional gravel if needed improves reliability of a frac pack/gravel pack process.

2. Description of the Related Art

Subsequent to the drilling of a subterranean oil or gas well, casing is typically set and perforated in conventional fashion. Unconsolidated formations, particularly those containing loose sands and sandstone strata, present problems in well production due to the migration of loose sands and degraded sandstone into the wellbore. A long-standing dilemma in the petroleum industry is the production of these unconsolidated materials in conjunction with the hydrocarbon production. Erosion of production equipment, well plugging, and reduced production levels or loss of the well are some consequences of this problem if left unaddressed.

One method of controlling the production of unconsolidated materials is gravel packing. Gravel packing is essentially a technique for building a two-stage filter downhole. The filter consists of gravel pack sand and a screen or liner. The gravel pack sand is sized according to the particle size distribution of the unconsolidated materials. One method of selecting gravel pack size is discussed in U.S. Pat. No. 3,670,817, entitled "Method of Gravel-Packing A Production Well Borehole,"incorporated herein by reference. The screen or liner has openings that are sized to retain the gravel pack sand. Thus the gravel pack sand retains the unconsolidated formation materials and the screen or liner retains the gravel pack sand. The gravel pack sand and the screen or liner act together to reduce or eliminate the production of the unconsolidated formation materials with the oil or gas production.

One problem associated with gravel packing which hinders hydrocarbon production is the trapping of formation damage in the reservoir. Formation damage can come from numerous sources. Drilling muds used during well construction can invade the formation blocking pore spaces and swelling clay materials in the reservoir. The perforating charges used to penetrate the casing and cement can crush the formation and generate significant quantities of fines (very small particle sized materials). Also, many times high viscosity polymer gels are used to control fluid losses to the reservoir after perforating. These polymer gels can also yield significant restrictions to production. The industry has resorted to fracturing the unconsolidated formations in an effort to bypass any damage which may be trapped by the gravel pack. The term "Frac Pack" is used to describe hydraulically fracturing an unconsolidated formation and at the same time building the two-stage filter of the gravel pack.

In the course of preparing a subterranean well for the installation of a Frac Pack, the well is perforated and the Frac Pack assembly run into the well on a workstring. The Frac Pack assembly generally consists of a well packer containing a crossover service tool and one or more screens or liners. The crossover service tool allows fluid flow in the workstring to exit in an annulus below the packer after the packer is set. Generally the crossover service tool has at least two ports, a primary port ans a circulating port. The primary port allows sand slurry to be pumped down the workstring and into the screen/casing annulus. The circulating port allows gravel pack sand slurry carrier fluid to flow into the workstring/casing annulus above the packer. These two ports allow the crossover service tool to have four fluid flow positions. One of the positions is the squeeze position, where the primary port is below the packer and the circulating port is sealed in the packer bore. This position forces all fluid flow into the formation. Another position is the lower circulating position, where the primary port is below the packer and the circulating port is open above the packer. This position allows fluid to flow into the annulus below the packer, through openings in the gravel pack screen or liner, through a return in the crossover service tool bypass area, out of the circulating port, and into the workstring/casing annulus above the packer. Another position is the upper circulating position, where the primary port is positioned above the packer. Fluid can be pumped down the workstring directly into the workstring/casing annulus above the packer. The last position is the reverse position, where either the circulating port and/or primary port is above the packer and fluid is pumped into the worksheet/casing annulus and into the workstring.

At the well site, the casing is perforated across the productions zone to allow production fluids to enter the wellbore. Primary sand screens are installed in the flow path opposite the perforations in the casing. Packers are set above and below the sand screens to seal off the annular region where production fluids are permitted to flow into the tubing. The crossover service tool is then release from the packer and positioned to perform either a gravel pack or Frac Pack.

In a typical gravel pack installation, the gravel pack sand slurry is generally pumped at low rates, about 2 to about 4 barrels per minute. The crossover service tool is placed in the upper circulating position and the gravel pack sand slurry is pumped into the workstring until the gravel pack sand slurry is within about 150 to about 300 feet of the primary port. The crossover service tool is then positioned into the lower circulating position and pumping continued. This allows the sand slurry to travel into the screen/casing annulus. The sand is retained by the screen or liner and the gravel pack carrier fluid travels into the workstring/casing annulus above the packer. When the pump pressure at the surface indicates gravel pack sand has covered the screen or liner the crossover service tool is placed in the squeeze position to force sand slurry into the perforations. The gravel pack carrier fluid leaks off into the formation allowing a tightly packed sand filter to remain in place. When the pump pressure at the surface reaches sand out pressure, usually about 1500 pounds per square inch above the circulating pressure, the pumps are switched from the workstring to the annulus. The annulus is pressurized with completion fluid and the crossover service tool is placed in the reverse position and any excess gravel pack slurry is reversed from the workstring. After waiting a sufficient time (usually about two hours) for the gravel pack sand in the annulus between the casing and screen or liner to settle, the crossover service tool is again placed in the lower circulating position. The workstring is then pressurized to ensure that the screen or liner is completely covered with gravel pack sand. The crossover service tool is pulled from the well and additional zones gravel packed or production seals and production tubing run into the well.

In a Frac Pack installation, the Frac Pack sand slurry is generally pumped at high rates, about 6 to about 12 barrels per minute. The crossover service tool is placed in the upper circulating position and the Frac Pack sand slurry pumped into the workstring until the gravel pack sand slurry is within about 150 and about 300 feet of the primary port. The crossover service tool is then positioned into the squeeze position and pumping continued. This allows the sand slurry to travel into screen/casing annulus, through the perforations and into the formation. Pumping continues until a tip screen out is achieved. At this point, the surface area of the fracture is dehydrated and the Frac Pack sand slurry in the fracture creates a wide fracture width and bypassing any potential formation damage. When the pump pressure at the surface indicates no additional sand can be placed in the fracture, the crossover service tool is placed in the lower circulating position to dehydrate Frac Pack sand against the screen or liner. The sand is retained by the screen or liner and the Frac Pack carrier fluid travels into the workstring/casing annulus above the packer. When the pump pressure at the surface reaches sand out pressure, usually about 1500 pounds per square inch above the circulating pressure, the pumps are switched from the workstring to the annulus. The annulus is pressurized with completion fluid and the crossover service tool is placed in the reverse position and any excess Frac Pack slurry is reversed from the workstring. After waiting a sufficient time (usually about two hours) for the Frac Pack sand in the annulus between the casing and screen or liner to settle, the crossover service tool is again placed in the lower circulating position. The workstring is then pressurized to ensure that the screen or liner is completely covered with Frac Pack sand. The crossover service tool is pulled from the well and production seals and production tubing run into the well. Typical gravel packing and frac packing methods are shown in the prior art, examples include U.S. Pat. No. 3,987,854, entitled "Gravel Packing Apparatus and Method;" U.S. Pat. No. 4,606,408, entitled "Method and Apparatus For Gravel Packing A Well;" and U.S. Pat. No. 4,627,488, entitled "Isolation Gravel Packer," incorporated herein by reference. Such typical and other prior art gravel packing assemblies contain a form of the crossover service tool.

There are other methods of gravel packing and frac packing which do not utilize a crossover service tool. One method is a bottom up treatment described in U.S. Pat. No. 2,978,024, entitled "Method of Gravel Packing Well Treatment;" U.S. Pat. No. 3,602,307, entitled, "Apparatus and Method for Gravel Packing Wells;" and U.S. Pat. No. 5,722,490, entitled, "Method of Completing and Hydraulic Fracturing of a Well," incorporated herein by reference. These ability to establish a circulating position to test the annular integrity of the gravel or frac sand in the screen/casing annulus.

The multiple flow positions obtainable with the crossover service tool makes it the preferred method of installing a gravel pack or Frac Pack completion. It has been observed that the turbulence within the downwardly flowing gravel packing or fracturing sand slurries results in an actual erosion or cutting of the internal wall of the crossover service tool. The erosion can be severe enough to cut entirely through the crossover service tool primary flow port causing communication with the return fluid flow path to the circulating port. This communication between the primary and circulating ports can prevent gravel pack or Frac Pack slurry placement in the screen/casing annulus. In a worst case scenario, the gravel pack or Frac Pack slurry can travel inside the screen or liner. When this problem is encountered, the well must be completely closed in and the workstring, packer, and liner assembly with the crossover service tool must be completely withdrawn from the well and replaced. This results in considerable downtime and extra rig time utilization. The turbulent fluid effects upon gravel packing systems during Frac Pack operations is discussed by the inventor in paper number 22857 of the Society of Petroleum Engineers entitled "Study of Effects Upon Gravel-Pack Systems During Frac/Pack Operations," (1991).

Another problem that is encountered in Frac Pack operations is the result of the high flow rates required to fracture the formations and discus drag forces of the gravel pack or Frac Pack slurries. The high flow rates make it difficult to anticipate a wellbore screen out. The screens or liners are normally positioned to extend above the perforations. As the perforations become covered with sand, all flow into the formation must first go through the screen or liner assembly. The high flow rates and discus drag forces can cause damage to the screen or liner resulting in an inability to retain the gravel pack or Frac Pack sand. When the well is placed on production the integrity of the two-stage filter is lost and sand may be produced with the hydrocarbons.

Thus, there is a need in the art for a more efficient system for frac packing a well that does not requires use of a crossover service tools, yet allows for installation and testing of a gravel pack assembly even after well fracturing.

SUMMARY OF THE INVENTION

The present invention provides a method of gravel packing and fracturing a subterranean well including the steps of placing a screen or liner assembly in the well with a one-way flow device or check valve, called the flow control valve, at a top of the screen assembly such that only flow from inside the screen or liner assembly is allowed. Once the assembly is in the well, a workstring is positioned above the screen or liner assembly. Next, gravel packing or frac packing is performed such that a slurry enters a formation in a squeeze mode. Next, a distal end of the workstring is sealed onto the top of the gravel pack screen or liner assembly. Next, the screen/casing annulus is pressure tested in a circulating mode by pumping fluids into a workstring/casing annulus at the surface. After insuring that the screen or liner and casing annulus is sufficiently covered with gravel pack or frac sand, the flow control valve may be removed with the workstring or the workstring may be removed and completion equipment run into the well. After the completion equipment has been placed in the well, the flow control valve may be removed with coil tubing or a wireline, if not having been already removed. Alternatively, the flow control valve may be left in place or pushed out of the production flow path and left in the wellbore.

The present invention provides a system for gravel packing and fracturing a subterranean well without the use of a crossover service tool, where the system includes a screen or liner assembly having a one-way flow device or check valve, called the flow control valve, at a top of the screen assembly such that only flow from inside the screen or liner assembly is allowed and a workstring adapted to be positioned above the screen or liner assembly, where gravel packing or frac packing slurry enters a formation in a squeeze mode, followed by sealing of a distal end of the workstring onto the top of the gravel pack screen or liner assembly and pressure testing the screen/casing annulus in a circulating mode.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
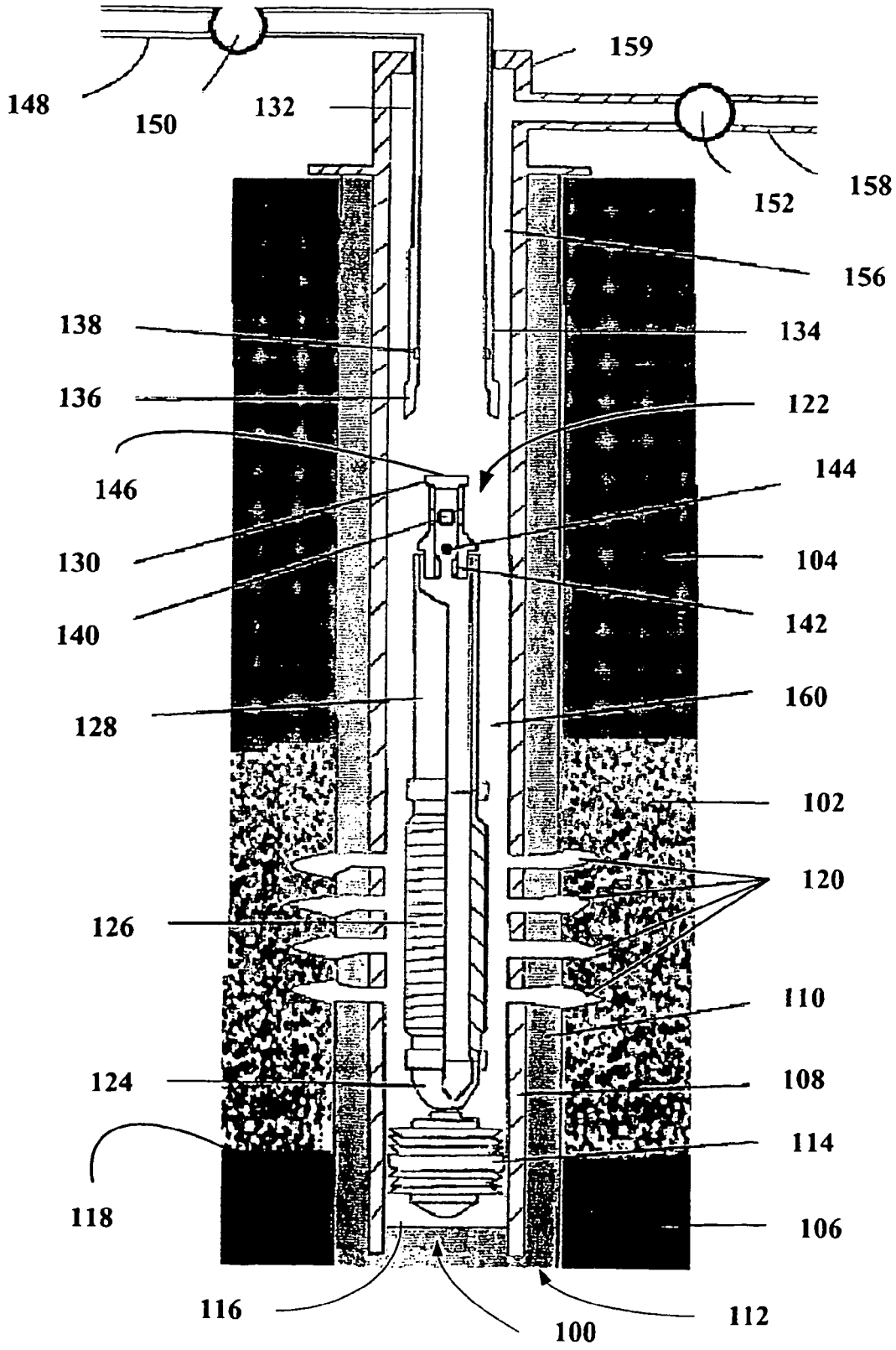
FIG. 1 is a schematic illustrating the screen or liner positioned across from the perforations and formation requiring gravel packing or frac packing with the workstring positioned above the screen or liner assembly. The flow control valve is positioned at the top of the screen. This is the positioning of the downhole equipment and tools prior to performing pumping operations.

The inventor has found that a formation may be fractured by placing a gravel pack screen in the wellbore, pumping sand slurry at high enough rates and pressure to fracture the earthen formation surrounding the wellbore, and after achieving the desired fracture length and width, utilize pressure and rate in a circulating position to test for sufficient gravel filling of the screen/casing annulus.

The present invention broadly relates to a system for gravel packing and fracturing a subterranean well without the use of a crossover service tool, where the system includes a screen or liner assembly having a one-way flow device or check valve, called the flow control valve, at a top of the screen assembly such that only flow from inside the screen or liner assembly is allowed and a workstring adapted to be positioned above the screen or liner assembly, where gravel packing or frac packing slurry enters a formation in a squeeze mode, followed by sealing of a distal end of the workstring onto the top of the gravel pack screen or liner assembly and pressure testing the screen/casing annulus in a circulating mode.

The present invention also broadly relates to a method of gravel packing and fracturing a subterranean well including the steps of:

placing a screen or liner assembly in the well with a one-way flow device or check valve, called the flow control valve, at a top of the screen assembly such that only flow from inside the screen or liner assembly is allowed;

positioning a workstring is positioned above the screen or liner assembly;

performing gravel packing or frac packing such that a slurry enters a formation in a squeeze mode;

sealing a distal end of the workstring onto the top of the gravel pack screen or liner assembly; and pressure testing the screen/casing annulus in a circulating mode by pumping fluids into a workstring/casing annulus at the surface.

The method can also include the step of, after insuring that the screen or liner and casing annulus is sufficiently covered with gravel pack or frac sand, removing the flow control valve and the workstring or just the workstring and installing completion equipment in the well. Alternatively, after the completion equipment has been placed in the well, the flow control valve may be removed with coil tubing or a wireline, if not having been already removed or the flow control valve may be left in place or pushed out of the production flow path and left in the wellbore.

In the placing screen assembly step, a workstring can be run into the well and the screen or liner released hydraulicly or mechanically. Coil tubing or a wireline may also be used to position the screen in the wellbore. The flow control valve can be a flapper assembly, a profile plug, ball valve, sleeved port, or any other device that can stop flow from outside the screen, but will allow flow from inside the screen. Washpipe may be attached to the flow control valve internal to the screen or liner to ensure that fluid flow will travel all the way to the bottom of the screen or liner during pressure testing of the screen/casing annulus in the circulating mode. Also, pressure gauges, flow meters, temperature probes, and/or other monitoring devices may be attached to the flow control valve to access the packing process or relate reservoir properties before and after pumping operations have been completed.

In the positioning step, the workstring is preferably positioned to minimize any turbulence or erosion at the top of the screen or liner assembly. A distance between the end of the workstring and the top of the screen or liner assembly of about 10 to about 50 times an internal diameter of the workstring is generally sufficient to prevent erosion. The rheological properties of the fluid will dictate the minimum distance requirements to avoid turbulence. However, for field operations practicality, the minimum distance between the end of the workstring and the top of the screen or liner assembly is about 30 feet (removing 1 joint of pipe from the workstring) with a distance of about 180 feet (removing two stands of three joints of pipe from the workstring) being preferred, which is more than sufficient to avoid erosion to the flow valve and top of the screen or liner. A packer may be used in the workstring to isolate the casing above the packer setting point from the fluid pumping pressures used to place the gravel pack or Frac Pack slurry into the formation.

In the performing step, the flow in the workstring/casing annulus is preferably controlled such that circulation can be regulated to force fluids into the formation. The gravel pack or Frac Pack slurries can then be circulated to the end of the workstring by taking returns up the workstring/casing annulus. The casing returns can then be closed off forcing all fluids into the perforations and formation. If a packer is used in the workstring, the slurry can be pumped to the end of the tubing by taking returns up the workstring/casing annulus, the packer in the workstring can then be set to isolate the casing area above the workstring from the gravel packing or fracturing pressures while forcing all flow into the perforations and formation. The pump pressures are monitored at the surface to determine when the perforations and formation have accepted the maximum quantity of fluids or slurry. After reaching the desired pressure, any excess slurry remaining in the workstring can be reversed from the well by pumping into the workstring/casing annulus and taking returns up the workstring to the surface. Usual practice is to reverse about 2 to about 3 tubing volumes to ensure all excess sand is removed.

In the sealing step, the workstring is repositioned to seal over the top of the gravel pack screen or liner assembly such that the flow control valve is isolated inside the workstring. The workstring and gravel pack screen or liner assembly now act as a continuous assembly. This can be accomplished with an overshot seal assembly that seals on the outside diameter at the top of the screen or liner assembly. Pressure may be applied to the workstring to ensure that the seal will hold pressure and is not leaking. Other means of sealing the workstring at the top of the screen or liner assembly may be utilized such as sealing internally in a seal receptacle at the top of the screen or liner assembly.

In pressure testing step, the workstring/casing annulus is now pressurized to determine if the screen/casing annulus has sufficient sand to cover the screen or slotted liner. This sufficient covering is determined by allowing circulation down the annulus through the annulus sand column surrounding the screen assembly, into the screen, and back up the workstring. If the screen aasembly is covered with sand, pressure will build as flow occurs through the sand annular sand column following Darcy's Law. If the screen is uncovered, the well should circulate freely with minimal pump pressures indicating additional sand needs to be pumped into the screen/casing annulus. Additional sand can be mixed in the fluid at the surface and circulated to the screen until the pressure response indicates that the screen is covered. Once again, any excess sand can be reversed out of the well by disconnecting the workstring from the top of the screen or liner assembly and pumping down the workstring casing annulus taking returns up the workstring.

After completing the gravel pack or Frac Pack, the flow control valve may be removed from the top of the screen or liner either before or after the completion/production equipment is run into position in the well. The flow control valve can be retrieved with a fishing tool built into the workstring to remove the flow control valve prior to running the completion/production equipment. Alternatively, the flow control valve may be removed with wireline or coil tubing after the completion/production equipment are run into the well. Those that are skilled in the art of removing plugs from tubing nipples will understand the options available for removing the flow control valve from the gravel pack screen or liner.

This method of gravel packing or frac packing eliminates the need for a crossover service tool, while maintaining the advantage of insuring complete filling of the screen/casing annulus with gravel pack or frac sand. Concerns about crossover service tool erosion are eliminated and reliability increased. It should also be understood that the same method may be employed where the screen or liner is positioned across an openhole section requiring frac packing.

Referring to FIG. 1, a well 100 has been drilled through target formation 102, with a formation 104 above the target formation 102 and a bottom formation 106 below the target formation 102. A casing 108 has been run into the well 100 and cement 110 placed on an outside 112 of the casing 108 to isolate the productive formation 102. A bridge plug packer 114 has been run to a position 116 near a bottom 118 of the formation 102 to provide a secure known bottom in the wellbore 100. Communication between the wellbore 100 and productive formation 102 has been established through perforations 120. A screen assembly 122 including a bull plug 124, screen 126, blank pipe 128, and a flow control valve 130, has been run into the well 100 on a workstring 132, connected through a overshot running tool 134. The overshot running tool 132 includes an entry guide 136 and seal assembly 138. The screen assembly 122 is held in place inside the overshot running tool 134 with shear screws (not shown) during run-in and released utilizing hydraulic pressure applied through the workstring 132. Hydraulic pressure can only be applied to the shear screws to release the screen assembly 122 if the flow control valve 130 is holding pressure. The flow control valve 130 includes flow ports 140, a ball seat 142, and a free floating ball 144. As hydraulic pressure is applied to the workstring 132, pressure communicates through the flow ports 140 and is applied against the ball 144 as it seals on the ball seat 142. As pressure is applied to the workstring 132, at approximately 1500 psi, the shear screws are sheared releasing the screen assembly 122 from the workstring 132. Those skilled in the art will understand that hydraulic force can be applied to act on shear screws or collect mechanisms to release the screen assembly form the workstring. As previously stated, there are many different alternatives for placing the screen assembly with the flow control valve 130 in the wellbore 100. For the purposes of the invention it is important to have the screen 126, in close proximity or adjacent to the perforations 120. After the screen assembly 122 is in place, one to two stands of the workstring 132 are pulled from the wellbore 100 positioning reentry guide 136, about 90 to about 180 feet above a top 146 of the flow control valve 130 of the screen assembly 122. The well 100 is now ready for fracturing or gravel packing.

Figure 2:
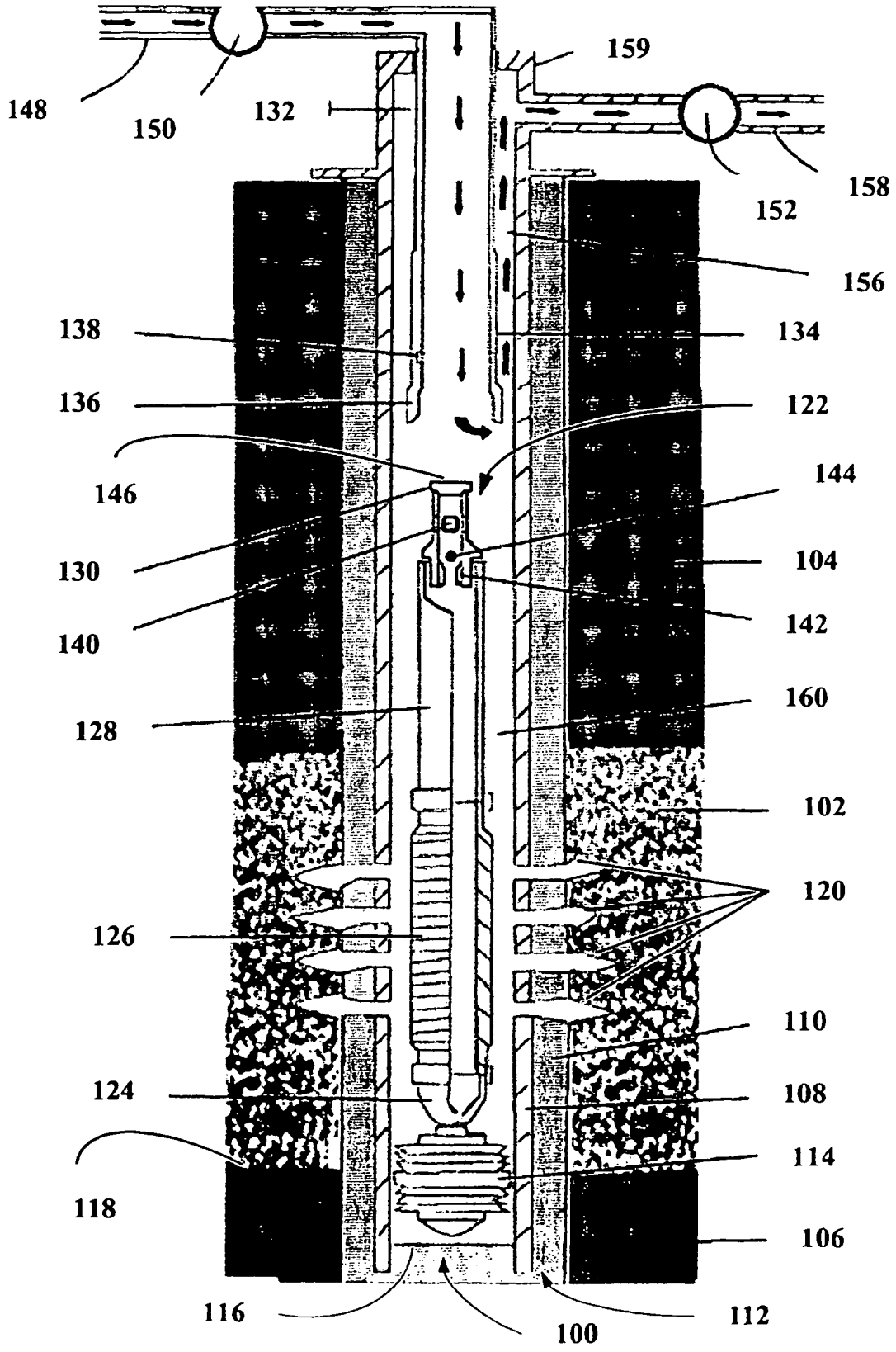
FIG. 2 is a schematic illustrating the flow path for circulating the gravel pack or Frac Pack slurry to the end of the workstring. The flow path is indicated by the arrows.

Referring to FIG. 2, the fracturing or gravel pack sand slurry is pumped into a surface line 148, through a valve 150, into workstring 132, a casing flow line valve 152 is in an open position which allows slurry to be pumped to an end 154 of the workstring 132 17, while taking returns up the workstring/casing annulus 156 and out a casing flow line 158 associated with a processing tree 159 on top of the casing 108. Once the sand slurry is within about 150 feet of the reentry guide 136, the casing flow line valve 152 is closed.

Figure 3:
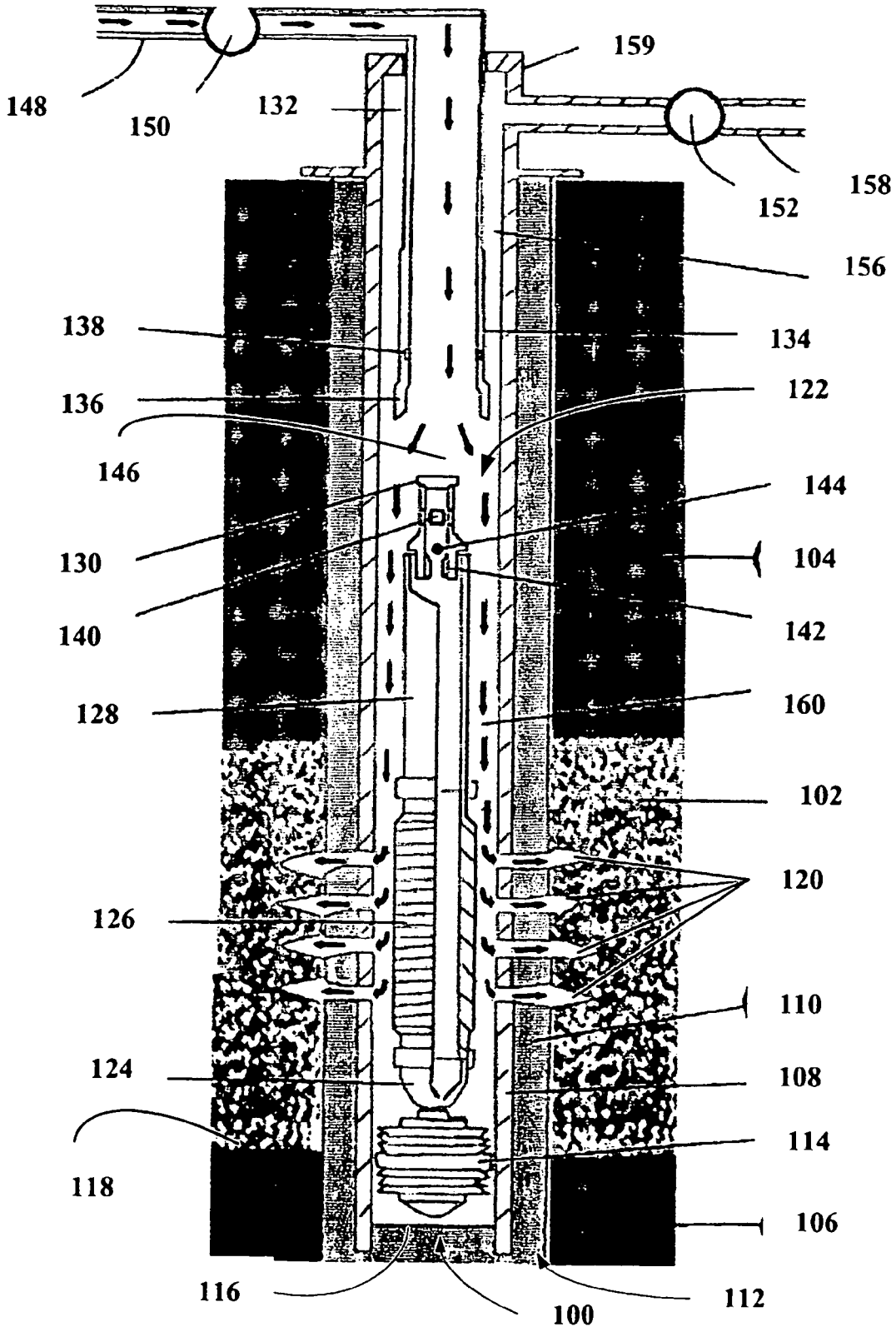
FIG. 3 is a schematic that illustrates the flow path of the gravel pack or Frac Pack slurry for pumping the gravel pack or Frac Pack slurry through the perforations and into the formation.

Referring to FIG. 3, after closing the casing flow valve all flow is forced downward into a screen/casing 160. The sand slurry travels through the perforations 120 and enters the target formation 102. The difference between a gravel pack and Frac Pack during this operation is the pump rates and pressures. During a gravel pack, the gravel carrier fluid leaks off into the formation 102 building a sand pack against the sand face, filling the perforations 120. During a Frac Pack, the pump rates are high enough to cause a resulting pressure that parts or fractures the formation 102. As the surface area of the fracture face grows, more area is available for the pumped fluid to leak off; the pressure in the fracture reaches a point where no additional fracturing can occur. Sand is then deposited into the fracture against the formation sand face to keep the fracture open after the pressure is released. In either case, a pressure is reached termed the formation sandout pressure, usually between about 1000 and about 2500 pounds per square inch above the initial injection or fracturing pressure. At this point, any excess slurry is preferably reversed out of the workstring.

Figure 4:
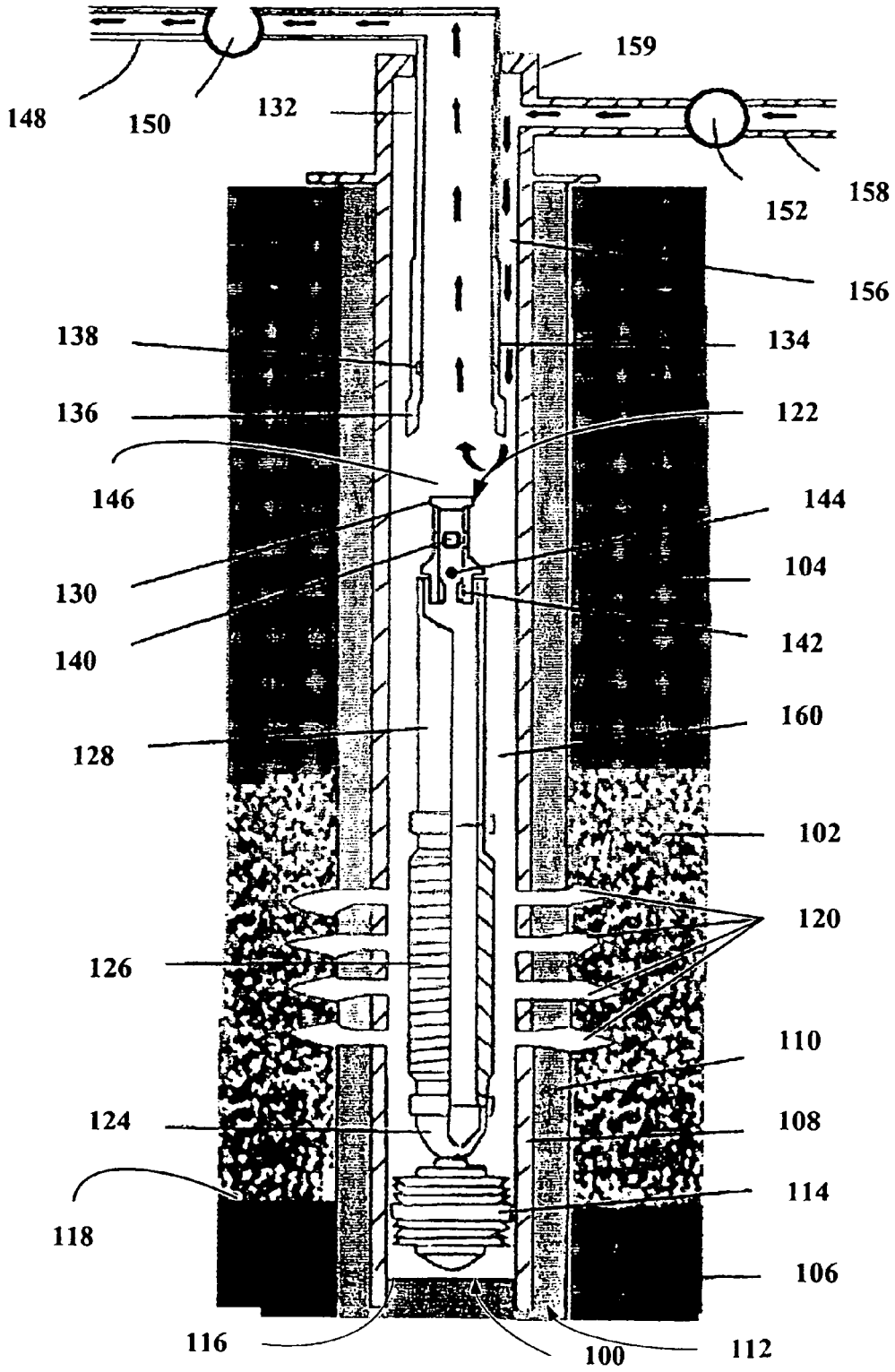
FIG. 4 is a schematic that illustrates the flow path for reversing any excess slurry from the workstring.

Referring to FIG. 4, pressure from the formation sandout is bleed off through the workstring 132 through the surface flow line 148. Fluid is then pumped through the casing flow line 158 into the workstring/casing annulus 156 at a pump rate to exceed a velocity of about 300 feet per minute in the workstring 132. Pumping preferably continues for at least about 3 workstring volumes or until the returns coming out of the surface flow line 148 are clean and do not contain any gravel pack or frac sand. After waiting a period of about two hours, the sand coverage in the annulus between the screen assembly 122 and the screen/casing 160 is preferably tested to ensure the screen 126 is completely covered.

Figure 5:
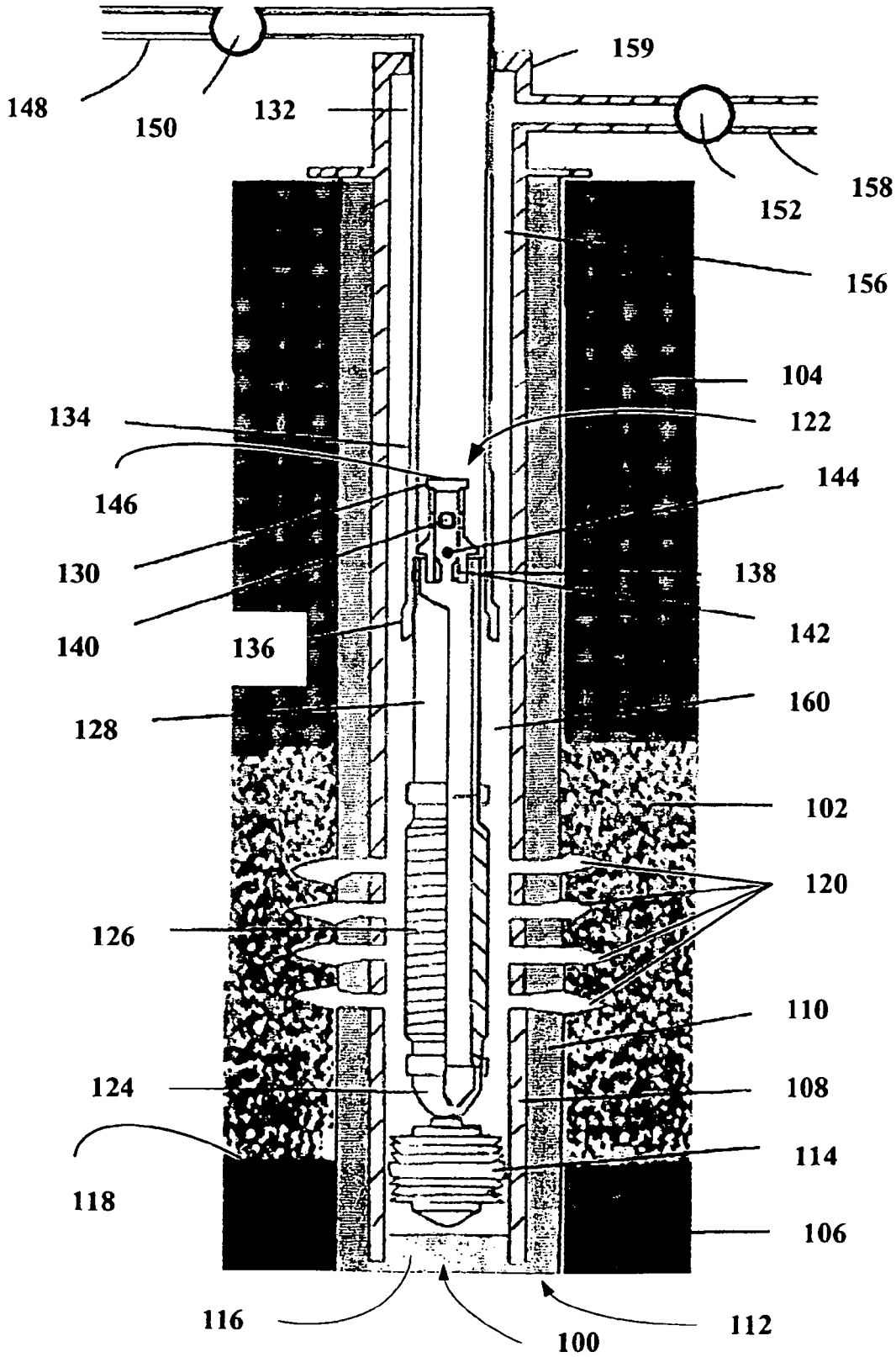
FIG. 5 is a schematic that illustrates repositioning the workstring to seal on top of the screen or liner assembly.
Figure 6:
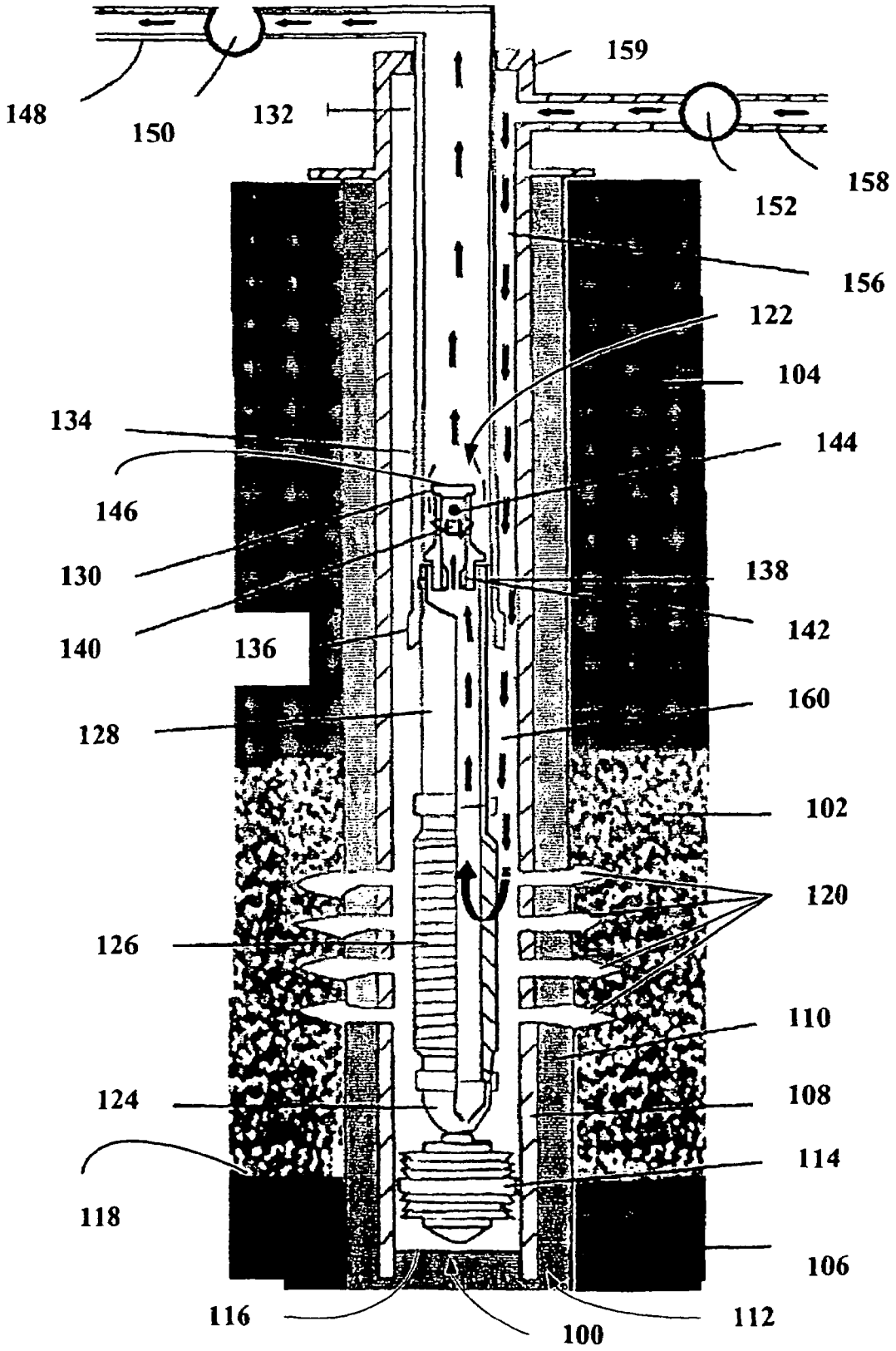
FIG. 6 is a schematic that illustrates the flow path for testing the annulus between the casing and the screen or liner or pumping additional sand if required.
Figure 7:
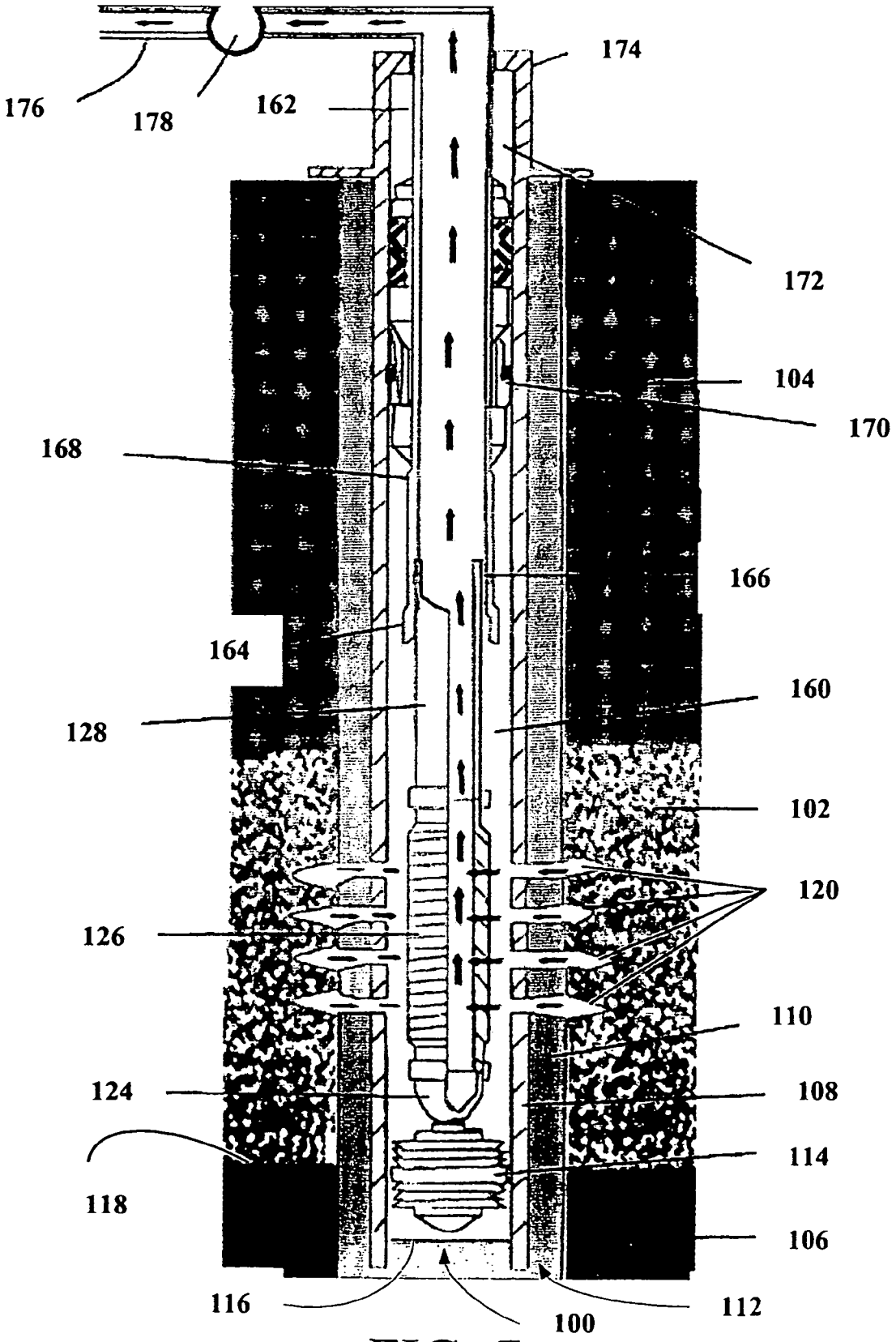
FIG. 7 is a schematic of the well in a producing mode.

Referring to FIG. 5, the workstring 132 is lowered in the well 100 such that the overshot running tool 134 is completely over the top 146 of the screen assembly 122 and that the seals 138 have engaged the assembly 122. This can be determined by pressuring down the workstring 132 and observing a surface pressure increase. The annulus 156 can then be pressured by pumping into the casing flow line 158. Referring to FIG. 6, the flow path for any fluid flow is down the annuluses 156 and 160, through the screen 126, back up the blank pipe 128, through the flow control valve 130, up the workstring 132, and through the surface flow line 148. If the screen 126 is not covered with gravel pack or Frac Pack sand, no pump pressure other than normal circulating pressures will be observed and additional sand can be circulated into place by pumping sand slurry through the casing flow line 158 and into the annulus 156 and 160. If screen 126 is covered with sand and the sand extends upwards in annulus 160 to cover a portion of the blank pipe 128, Darcy's Law dictates that a pressure increase will be noted. The amount of pressure increase is dependent upon the equivalent hydraulic radius of the annulus between the blank pipe 128 and casing 108, the fluid viscosity being pumped, and the permeability of the gravel pack or frac sand. If non-viscosified water is pumped, a pump pressure of about 250 to about 750 pounds per square inch above an initial circulating pump pressure is an indication that blank pipe 128 is partially covered with sand and consequently screen 126 is covered with sand and pumping operations are complete. The workstring 132 is then pulled from the well 100. As shown in FIG. 7, production tubing 162 is run into the well with a production entry guide 164, production seals 166, and a production overshot 168 below a production packer 170. The production seals 166 are tested by pressuring down annuluses 172 and 160 prior to setting the packer 170. The packer 170 is then set and tested by pressuring down annulus 172. A production tree 174 is placed on the casing 108 and the tubing string 162. Wireline or coil tubing is used to remove the flow control valve 130 through tubing 162. A production flow line 176 including a valve 178 is run between the well 100 and production facilities allowing the well 100 to be placed on production. The produced fluid flow path is from the formation 102, through the fracture or packer perforations 120, into the screen 126, and upwards through the production tubing 162 to the surface.

The preferred embodiment described above is not meant to be a limitation. It has previously been noted that many different flow control valves, and screen assembly placement means may be used in conjunction with the methods of this invention. Also, some steps may be eliminated due to well conditions or to simplify operations such as in the case of low bottom hole pressure wells. Generally these types of wells cannot support a column of fluid. Circulating fluid to the end of the tubing shown in FIG. 2 becomes impractical as all fluid flow is already going into the formation as is shown by the flow diagram in FIG. 3. It may also be desirable to protect the upper casing strings and surface equipment isolated from any sand-out pressures by running a packer in the workstring above the overshot assembly. There are other variations in equipment and flow that those skilled in the art would recognize as being beneficial for certain well conditions or completion operations which could be used in conjunction with the disclosed method. Also, while the invention is related to gravel packing or frac packing, the same method would apply to acid placement and acid pre-packing which is another means of formation treatment and gravel packing which is normally performed through a crossover service tool.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A method of altering wellbore fluid flow paths for treating a target reservoir comprising:

positioning a screen or liner assembly including a flow control device adjacent a productive formation;

positioning the entirety of a workstring at a spaced distance above the screen or liner assembly;

performing a pumping operation with the entirety of said work string at a spaced distance above said screen or liner assembly for a sufficient time and at a sufficient rate and pressure to fracture the formation and while said flow control device is operative to regulate flow through said screen or liner in at least one direction;

repositioning the workstring while it is in the wellbore to form a seal between the workstring and said screen or liner assembly including said flow control device; and evaluating an effectiveness of the treatment after said repositioning;

producing through said screen or liner.

2. The method of claim 1, wherein the screen or liner assembly is positioned on a distal end of the workstring.

3. The method of claim 1, wherein the flow control device includes a washpipe attached internal to the screen or liner assembly.

4. The method of claim 3, wherein the flow control device includes at least one sensor for monitoring treatment parameters.

5. The method of claim 3, wherein the flow control device includes at least one sensor for monitoring reservoir parameters.

6. The method of claim 1, further including the step of:

removing the flow control device from the screen or liner assembly after the well treatment.

7. A method of altering wellbore fluid flow paths for treating a target reservoir comprising:

positioning in the wellbore with a wireline a screen or liner assembly connected at the distal end of said wireline, where the assembly includes a flow control device;

positioning the entirety of a workstring at a spaced distance above the screen or liner assembly;

performing a pumping operation with the entirety of said work string at a spaced distance above said screen or liner assembly for a sufficient time and at a sufficient rate and pressure to fracture the formation and while said flow control device is operative to regulate flow through said screen or liner in at least one direction;

repositioning the workstring while it is in the wellbore to form a seal between the workstring and screen or liner assembly including said flow control device;

evaluating an effectiveness of the treatment after said repositioning;

producing through said screen or liner.

8. The method of claims 7, wherein the workstring is coiled tubing.

9. A method of altering wellbore fluid flow paths for treating a target reservoir comprising:

positioning a screen or liner assembly adjacent to a productive formation, where the assembly includes a flow control device;

positioning the entirety of a workstring at a spaced distance above the screen or liner assembly;

performing a pumping operation with the entirety of said work string at a spaced distance above said screen or liner assembly for a sufficient time and at a sufficient rate and pressure to fracture the formation and while said flow control device is operative to regulate flow through said screen or liner in at least one direction repositioning the workstring while it is in the wellbore to form a seal between the workstring and screen or liner assembly including said flow control device;

evaluating the treatment after said repositioning;

performing additional pumping operations for a sufficient time and at a sufficient rate and pressure to further fracture the formation:

producing through said screen or liner.

10. A method of sand placement for treating a target reservoir comprising:

positioning a screen or liner assembly adjacent to a productive formation with a flow control device in the screen or liner assembly;

positioning the entirety of a workstring at a spaced distance above the screen or liner assembly;

performing a pumping operation with the entirety of said work string at a spaced distance above said screen or liner assembly for a sufficient time and at a sufficient rate and pressure to fracture the formation and while said flow control device is operative to regulate flow through said screen or liner in at least one direction;

repositioning the workstring while it is in the welibore to form a seal between the workstring and screen or liner assembly including said flow control device;

evaluating the sand coverage of the screen or liner after said repositioning;

producing through said screen or liner.

11. A method of sand placement for treating a target reservoir comprising:

positioning a screen or liner assembly adjacent to a productive formation with a flow control device in the screen or liner assembly;

positioning the entirety of a workstring at a spaced distance above the screen or liner assembly;

performing a pumping operation with the entirety of said work string at a spaced distance above said screen or liner assembly for a sufficient time and at a sufficient rate and pressure to fracture the formation and while said flow control device is operative to regulate flow through said screen or liner in at least one direction;

repositioning the workstring while it is in the wellbore to form a seal between the workstring and screen or liner assembly including said flow control device;

evaluating the sand coverage of the screen or liner after said repositioning;

performing additional pumping operations for a sufficient time and at a sufficient rate and pressure to further fracture the formation; and producing through said screen or liner.

12. A system for frac packing a well comprising a sand control screen or liner assembly adapted to be positioned adjacent a productive formation, where the assembly includes a flow control device that regulates flow through said screen or liner assembly in at least one direction as slurry is delivered to an annular space around said screen or liner assembly, a workstring adapted to position the assembly adjacent the productive formation and to be positioned in its entirety at a spaced distance above the assembly after assembly positioning, and a pump facility adapted to supply frac pack or gravel pack slurries to the assembly for a sufficient time, flow rate and pressure to fracture and pack the formation.

* * * * *